United States Patent [19]

Ballman et al.

[11] 3,966,866

[45] June 29, 1976

[54] POLYURETHANE FIBER UNIFORMITY

[75] Inventors: Richard L. Ballman, Gulf Breeze; Kenneth R. Lea, Pensacola; Walter J. Nunning; John H. Southern, both of Gulf Breeze, all of Fla.

[73] Assignee: Monsanto Company, St. Louis, Mo.

[22] Filed: July 15, 1974

[21] Appl. No.: 488,635

Related U.S. Application Data

[63] Continuation-in-part of Ser. No. 400,770, Sept. 26, 1973, abandoned.

[52] U.S. Cl. ..... 264/171; 260/77.5 SP

[51] Int. Cl.[2] ..... B29F 3/10

[58] Field of Search ..... 264/171; 260/77.5 SP

[56] References Cited

UNITED STATES PATENTS

| | | | |
|---|---|---|---|
| 3,174,949 | 3/1965 | Harper | 260/75 SP |
| 3,233,025 | 2/1966 | Frye et al. | 264/176 F |
| 3,357,954 | 12/1967 | Kirkaldy | 260/77.5 SP |
| 3,402,097 | 9/1968 | Knudsen et al. | 161/178 |
| 3,642,964 | 2/1972 | Rausch et al. | 264/176 F |
| 3,668,185 | 6/1972 | Boutsicaris | 260/77.5 SP |
| 3,761,348 | 9/1973 | Chamberlin | 161/173 |

FOREIGN PATENTS OR APPLICATIONS

| | | | |
|---|---|---|---|
| 43-6105 | 3/1968 | Japan | 264/176 F |

*Primary Examiner*—Jay H. Woo
*Attorney, Agent, or Firm*—Kelly O. Corley

[57] ABSTRACT

A particular elastomeric polyurethane polymer is heated to about 225°C. to ensure complete melting prior to extrusion side-by-side with a molten hard polymer. The polyurethane polymer is made from an aromatic diisocyanate, a high molecular weight (800–3000) diol and a low molecular weight (500 or less) diol, combined in specific ratio ranges.

6 Claims, No Drawings

POLYURETHANE FIBER UNIFORMITY

CROSS-REFERENCE TO RELATED APPLICATION

This application is a continuation in part of our copending application Ser. No. 400,770 which was filed on Sept. 26, 1973 and now abandoned.

BACKGROUND OF THE INVENTION

The invention relates to a process for melt-spinning a side-by-side conjugate filament or yarn with improved control over the denier uniformity and over the shape of the interface between the two polymer components.

In melt spinning a conjugate yarn from a hard polymer and a particular type of polyurethane more fully described below, considerable difficulties were experienced due to variable denier and to a variable shape of the interface between the two polymers. When the yarn is drawn and permitted to relax, a variable bulk level was obtained, attributable to variations in the shape of the interface.

It has been discovered that denier uniformity can be improved and the shape of the interface controlled by heating the polyurethane polymer to a temperature range as defined below prior to its extrusion as part of a conjugate yarn.

Accordingly a primary object of the invention is to provide a process for controlling denier uniformity of a conjugate yarn melt spun from a particular type of polyurethane polymer and from a hard polymer.

A further object is to provide a process for controlling the shape of the interface between the hard polymer and the polyurethane polymer.

Other objects will in part appear hereinafter and will in part be obvious from the following detailed disclosure.

Because minor variations in chemical structure and physical characteristics are difficult to determine adequately in general, the polyurethanes useful according to the invention are most conveniently described in terms of the chemical reactants used to prepare the polyurethane. Broadly, the polyurethanes are made by reacting together (1) a polymeric glycol, which may be a hydroxy-terminated polyester or polyether, having an average molecular weight in the range 800–3000; (2) between 4.6 and 8.8 mols aromatic diisocyanate per mol of polyester or polyether; and (3) sufficient polyol chain-extending agent to provide an NCO/OH ratio between 0.96 and 1.04 to 1.

Suitable polyesters have a molecular weight in the range of about 800–3000 and are obtained by the normal condensation reaction of dicarboxylic acid with a glycol or from a polymerizable lactone. Preferred polyesters are derived from adipic acid, glutaric and sebacic acid which are condensed with a moderate excess of such glycols as ethylene glycol; 1,4-butylene glycol; propylene glycols; diethylene glycol; dipropylene glycol; 2,3-butanediol; 1,3-butanediol; 2,5-hexanediol; 1,3-dihydroxy-2, 2.4-trimethylpentane; mixtures thereof; etc. Useful polyesters may also be prepared by the reaction of caprolactone with an initiator such as glycol, preferably with the molecular weight of the product polyester being restricted to the range 1500–2000. Included among suitable polyethers having molecular weights in the range of 800–3000 are poly(oxyethylene) glycol; polyoxypropylene glycol; poly(1,4-oxybutylene) glycol;

Diisocyanates suitable for the preparation of polyurethanes according to the invention are those diisocyanates wherein the —NCO group is directly attached to an aromatic nucleus, as in 4,4′-diphenylmethane diisocyanate.

Many different common diols or mixtures of diols can be used as the low molecular weight polyol or chain extender. Examples are 1,4 butanediol; ethylene glycol; propylene glycol; and 1,4-B-hydroxyethoxy benzene. The combination of low molecular weight polyol and diisocyanate, as to type and amount, preferably is chosen so as to provide DTA melting point of the polyurethane polymer in the range of 200°–235°C. The polyol should be primarily composed of one or more diols having a molecular weight below 500, although it may be desirable to include as part of the polyol a small molar amount of a multifunctional compound containing three or more hydroxyl groups per molecule. In such a case, the latter compound can have a molecular weight up to 1,500. Amounts up to 0.3 mols of the multifunctional compound per mol of the high molecular weight diol can be used, although ordinarily only about 1/10 or less of this amount (e.g. 0.03 mols or less) need be added for viscosity control. Typical multifunctional compounds are glycerine, trimethylol propane, hexanetriol and the like. When the multifunctional compound is used, the NCO/OH ratio may be between 0.96 and 1.04 to 1; otherwise it should be between 1.01 and 1.04 to 1. The combination of isocyanate and polyol both as to type and amount, must be chosen so as to provide a DTA melting point in the range of about 200°–235°C.

The chemistry and preparation of elastomeric polyurethanes is treated comprehensively in *Polyurethanes: Chemistry and Technology*, by J. H. Saunders and K. C. Frisch, Part II, Chapter 9, Interscience Publishers, Inc. (1964). U.S. Pat. No. 3,214,411 issued to Saunders and Piggott may be consulted for specific details on the process of preparation of polyester-urethanes for filaments according to the present invention.

Particularly advantageous polyester-urethanes may be made by selecting certain specific reactants and combining them within fairly narrow ranges of proportions as indicated by this general recipe:

100 parts by weight of poly(1,4-butylene) adipate having a molecular weight of 1500–2000;

55–110 parts by weight of 4,4′-diphenylmethane diisocyanate; and sufficient glycol to give a total NCO/OH ratio in the range of 1.01–1.04. The preferred chain-extending glycols are ethylene glycol; 1,4-butane diol; and 1,4-bis-(β-hydroxyethoxy benzene which is the glycol represented by the formula

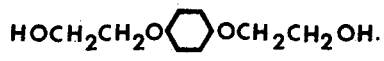

In the above formulation the NCO/OH ratio is an abbreviation for the ratio of equivalents of isocyanate groups to the total equivalents of hydroxy groups in the chain-extending glycol combined with the reactive groups in the polyester. The optimum molecular weight and polymer melt strength for maximum spinning speeds without the breaking of fine denier filaments are obtained when the NCO/OH ratio is in the range of about 1.01–1.04.

The polyurethanes in filaments of the invention are regarded as block copolymers in which the polyurethane block melts at a temperature above about 200°C. but below about 235°C. This melting point is measured by differential thermal analysis (DTA), and is indicated by a distinct endothermic peak in the thermogram as the base temperature of the polymer sample is raised. A general description and discussion of DTA methods is given in *Organic Analysis*, edited by A. Weissberger, Vol. 4, pp. 370–372, Interscience Publishers, Inc. (1960), and in various encyclopedias of Chemical technology. In the examples cited below, the DTA melting points were measured with a commercial duPont 900 DTA Instrument, manufactured by E. I. duPont de Nemours, Inc.

The two components (polyurethane-polyamide) are preferably extruded through single spinneret orifices in side-by-side relation; this arrangement provides the highest order of retractive force to the crimps. However, it is possible to extrude the two components through separate juxtaposed orifices and to coalesce the two extruded streams of molten polymer just below the extrusion face of the spinneret; this method is preferred with higher melting polyamides, such as nylon 66. When a crimp of reduced retractive force can be used a sheath-core structure of the polymers is made, provided that the core is eccentrically arranged with respect to the long axis of the filament. The sheath-core structure is preferred where extremely uniformed dyed appearance in the ultimate textile product is of importance. The two components are preferably present in approximately equal amounts by weight, but the relative amounts of the two components may vary from about 20–80% to 80–20% and a highly crimped structure is assured when at least 30% of the cross section of the spun filament is comprised of the polyurethane component. After extrusion the composite filament must be stretched. The filament can be cold-stretched or, if desirable, be hot-stretched as long as the desired tensile strength is obtained without unduly disrupting the adherence of the two components.

EXAMPLE 1

This illustrates preparation of an exemplary polyurethane of the type to which the invention is directed. One employs 100 parts by weight of polyester prepared from 1,4-butanediol and adipic acid. The polyester has a molecular weight of about 2000, a hydroxyl number of 55, and an acid number of 1.5. To the polyester are added 60 parts by weight of 4,4′-diphenylmethane diisocyanate and sufficient 1,4-butanediol (chain extender) to provide an NCO/OH ratio of 1.02. The 1,4-butanediol and polyester are blended together at 100°C. The 4,4-diphenyl methane diisocyanate, also heated to 100°C., is then added. The resulting mixture is then vigorously stirred for about 1 minute to insure thorough blending of the three ingredients. The blended reaction mixture is then cast on a flat surface in an oven heated to 130°C. The reaction mixture solidifies to a low molecular weight polyurethane polymer in about 2–3 minutes. The solid polyurethane polymer is kept in the heated oven for another 5–6 minutes to increase the molecular weight, and is then removed and cooled to room temperature. The resulting polymer slab is then chopped into flake of the desired size. The flake is then stored under an inert (nitrogen) atmosphere at less than 50°C., for example at room temperature, for at least 5 (preferably at least 20) days before spinning. The storage step improved spinning performance and reduces tackiness of the filaments, whether the polyurethane is melt-spun alone or conjugately with a hard fiber.

EXAMPLE 2

This is exemplary of the problem. The polyurethane flake prepared according to Example 1 is charged to a first screw extruder, and nylon 6 flake having a formic acid relative viscosity of 24 is charged to a second screw extruder. The principal spinning conditions are:

| | |
|---|---|
| Extruder outlet temperature | |
| Nylon 6 | 253°C. |
| Polyurethane | 218°C. |
| Polyurethane block temperature | 222°C. |
| Nylon 6 block temperature | 245°C. |
| Nylon 6/polyurethane ratio, by volume | 1:1 |
| Spinneret capillary diameter | 25 mils |
| Spinneret temperature | 225°C. |
| Spinning speed | 300 y.p.m. |

In this spinning system, the polymers are melted in extruders and fed to respective blocks maintained at the noted temperatures, the residence time in the extruders and blocks being about 3 minutes each for a total residence time of 6 minutes. The two molten polymers then enter separate chambers in the spin pack, where they are filtered. The residence time in the spin pack is about 2 minutes. The filtered polymers then are converged in a side-by-side relationship at the spinneret capillary and are extruded downwardly therefrom. The molten conjugated stream is then cooled in a conventional manner to solidify the polymers by a transverse flow of room temperature air, and wound on a bobbin in a conventional manner. The spun yarn thus produced is then cold drawn at a draw ratio of 4.05.

The resulting drawn yarn, when relieved of tension, develops a helical crimp. However, the crimp is somewhat irregular in intensity along the length of the yarn, and ladies' hose knit from the yarn and acid dyed show occasional dark circumferential rings.

Examination of the yarn shows that the shape of the interface between the two components varies irregularly along the length of the yarn. Further investigation shows that, although the polyurethane flake has a DTA melt point of 215°C., when held at elevated temperatures near 215°C. or a few degrees higher for several minutes, as occurred in the polyurethane polymer block, the DTA melt point increases irregularly to a temperature higher than 220°C. with this composition, and sometimes higher than 225°C. with other compositions, indicating the formation of some crystalline structure in the apparently molten polymer. This causes variations in the melt viscosity of the polyurethane passing through the spinneret orifice, leading to variations in the shape of the nylon-polyurethane interface.

EXAMPLE 3

This illustrates the process of the present invention. The process of Example 2 is repeated, except that the polyurethane polymer is heated to and held at 230°C. in its extruder and block prior to being fed to the 225°C. spinneret. The resulting drawn yarn has highly uniform denier and crimp, and a nylon-polyurethane interface which is substantially uniform along the length of the yarn. Hose knitted from the yarn and acid dyed were substantially free from rings.

The holding temperature necessary to prevent formation of the crystalline regions in the apparently molten polymer varies somewhat with the composition of the polymer, and obeys the following relationship $$T_{min} = \left[210.6 + 3 \left(\frac{\text{mols diisocyanate}}{\text{mols polymeric glycol}}\right)\right] °C.$$

wherein $T_{min}$ is the temperature in degrees centrigrade necessary to avoid the troublesome crystallinity. Higher temperatures can be used, depending on the duration of exposure, but should not exceed 255°C. for polymers of this type.

The minimum treatment period during which the actual polymer temperature is between $T_{min}$ and 255°C. is theoretically nearly zero seconds, since this range is above the melt point of the crystals. For practical purposes, a treatment period of at least 10 seconds will ordinarily assure that crystallinity will be avoided. The maximum time of exposure within this temperature range is determined by the degree of degradation acceptable in the polymer. Generally speaking, the treatment period should be as short as is conveniently possible, and increasingly so for higher temperatures within the range. The polymer in Example 3 above can be held at 230°C. for up to 8 minutes or somewhat longer without an objectionable amount of degradation, but after about 10 minutes, degradation is severe. Maximum treatment period for a given polymer composition and temperature can readily be determined by experiment.

We claim:

1. A process for preparing a conjugate fiber, comprising:

a. preparing a solid melt-spinnable fiber-forming polyurethane by reacting together 1. a polymeric glycol having a molecular weight between 800 and 3000,
2. between 4.6 and 8.8 mols of an aromatic diisocyanate per mol of said polymeric glycol, and
3. sufficient low molecular weight polyol to provide an NCO/OH ratio between 0.96 and 1.04 to 1;

b. heating said polyurethane to a temperature within the range from at least $$\left[210.6 + 3 \left(\frac{\text{mols diisocyanate}}{\text{mols polymeric glycol}}\right)\right] °C.$$

and less than 255°C. to form a first molten stream;

c. maintaining the temperature of said first molten stream within said range for a treatment period of at least 10 seconds and less than a treatment period which would cause objectionable degradation;

d. combining said first molten stream with a second molten stream in a side-by-side conjugate relationship to form a conjugated stream, said second molten stream being formed from a melted fiber-forming hard polymer;

e. extruding said conjugated stream through a spinneret orifice; and f. cooling said conjugated stream to form a conjugate yarn.

2. The process of claim 1, wherein said polyol comprises only a diol or diols, said NCO/OH ratio being between 1.01 and 1.04 to 1.

3. The process of claim 1, wherein said diisocyanate is 4,4'-diphenylmethane diisocyanate.

4. The process of claim 3, wherein said polymeric glycol is poly(1,4-butylene adipate) having a molecular weight between 1500 and 2000.

5. The process of claim 1, wherein said polyol comprises a diol having a molecular weight below 500 and a multifunctional compound containing at least three hydroxyl groups per molecule, there being no more than 0.3 mols of said multifunctional compound per mol of said polymeric glycol.

6. The process of claim 5, wherein there are no more than 0.03 mols of said multifunctional compound per mol of said polymeric glycol.

* * * * *